US011213446B2

(12) United States Patent
Koenig et al.

(10) Patent No.: US 11,213,446 B2
(45) Date of Patent: Jan. 4, 2022

(54) DEVICE FOR CONVERTING A BED, IN PARTICULAR A CARE BED, SICK BED, HOSPITAL BED, OR INTENSIVE-CARE BED, FROM A HORIZONTAL POSITION INTO AN INCLINED POSITION WITH RESPECT TO THE LOGITUDINAL SIDES OF THE BED

(71) Applicant: REACTIVE ROBOTICS GMBH, Munich (DE)

(72) Inventors: Alexander Koenig, Munich (DE); Simon Spiegel, Munich (DE)

(73) Assignee: ReActive Robotics GmbH, Munich (DE)

( * ) Notice: Subject to any disclaimer, the term of this patent is extended or adjusted under 35 U.S.C. 154(b) by 65 days.

(21) Appl. No.: 16/327,459

(22) PCT Filed: Aug. 10, 2017

(86) PCT No.: PCT/EP2017/070327
§ 371 (c)(1),
(2) Date: Feb. 22, 2019

(87) PCT Pub. No.: WO2018/036835
PCT Pub. Date: Mar. 1, 2018

(65) Prior Publication Data

US 2019/0183708 A1 Jun. 20, 2019

(30) Foreign Application Priority Data

Aug. 26, 2016 (DE) ..... 102016115982.4

(51) Int. Cl.
*A61G 7/08* (2006.01)
*A61H 1/02* (2006.01)
(Continued)

(52) U.S. Cl.
CPC ..... *A61G 7/08* (2013.01); *A61G 7/1063* (2013.01); *A61H 1/0229* (2013.01);
(Continued)

(58) Field of Classification Search
CPC . A61G 7/08; A61G 7/05; A61G 7/001; A61G 2203/80; A61G 2203/42;
(Continued)

(56) References Cited

U.S. PATENT DOCUMENTS 2,787,506 A * 4/1957 Travisano ..... A61G 7/005 5/610
2,821,722 A 2/1958 Benson
(Continued)

FOREIGN PATENT DOCUMENTS

DE 9420429 U1 3/1995
DE 202012002908 U1 6/2012
(Continued)

*Primary Examiner* — David R Hare
*Assistant Examiner* — Alexis Felix Lopez
(74) *Attorney, Agent, or Firm* — Laurence A. Greenberg; Werner H. Stemer; Ralph E. Locher

(57) ABSTRACT

A configuration for moving a bed, in particular a care bed, sick bed, or intensive-care bed, from a horizontal position into an inclined position with respect to the longitudinal sides of the bed. A receiving device for receiving the bed and a stand device for ensuring a stable stand of the configuration are operatively connected via an adjusting mechanism which inclines the receiving device relative to the stand device. The verticalization process is decoupled from the respective existing bed and thus allows a large degree of flexibility for care personnel during a routine therapy session, allowing a safe and comfortable therapy for a patient confined to a bed. The configuration according to the invention is suitable for both a new installation as well as for retrofitting medical and/or care device equipment and
(Continued)

advantageously saves on the otherwise necessary expenditures on beds with their own verticalization mechanism.

20 Claims, 7 Drawing Sheets

(51) Int. Cl.
*A61G 7/10* (2006.01)
*A61G 7/00* (2006.01)
*A61G 7/05* (2006.01)
*A61G 13/04* (2006.01)

(52) U.S. Cl.
CPC ..... *A61H 1/0237* (2013.01); *A61H 1/0259* (2013.01); *A61G 7/001* (2013.01); *A61G 7/05* (2013.01); *A61G 7/1051* (2013.01); *A61G 13/04* (2013.01); *A61G 2203/42* (2013.01); *A61G 2203/44* (2013.01); *A61G 2203/80* (2013.01); *A61H 2201/0142* (2013.01); *A61H 2201/164* (2013.01); *A61H 2201/1652* (2013.01)

(58) Field of Classification Search
CPC .. A61G 2203/44; A61G 13/04; A61H 1/0259; A61H 2201/0157; A61H 2201/0142; A61H 2201/0107; A61H 2201/1664
See application file for complete search history.

(56) References Cited

U.S. PATENT DOCUMENTS 2,887,691 A * 5/1959 Talarico ..... A61G 7/005 5/610
3,293,667 A * 12/1966 Ohrberg ..... A61G 7/005 5/610
3,310,289 A 3/1967 Burke
3,640,520 A * 2/1972 Wieland ..... A61G 13/009 5/610
5,580,207 A 12/1996 Kiebooms et al.
6,484,332 B2 * 11/2002 Korver, II ..... A61G 7/1017 5/601
6,954,951 B2 * 10/2005 Lieboff ..... A61G 5/00 5/603
7,472,441 B1 * 1/2009 Steffensmeier ..... A61G 13/009 5/610
7,594,284 B2 * 9/2009 Schuchardt ..... A61G 7/08 254/1 OR
7,597,656 B2 * 10/2009 Trees ..... A61H 1/0229 482/142
7,802,331 B2 * 9/2010 Brown ..... A47C 19/045 5/610
10,413,470 B2 * 9/2019 Xu ..... A61H 1/0244
2007/0174965 A1 * 8/2007 Lemire ..... A61G 7/0509 5/600
2007/0283492 A1 * 12/2007 Gallant ..... A61G 1/00 5/86.1
2008/0101903 A1 5/2008 Waner et al.
2009/0300845 A1 * 12/2009 Paz ..... A61G 7/053 5/610
2014/0338129 A1 * 11/2014 Mitchell ..... A61G 7/018 5/610
2015/0290061 A1 * 10/2015 Stafford ..... A63B 22/0089 5/600
2015/0320630 A1 * 11/2015 Bucher ..... A61H 1/0262 601/26
2017/0035638 A1 2/2017 Koenig
2018/0303696 A1 10/2018 Koenig et al.

FOREIGN PATENT DOCUMENTS

DE 102014105250 A1 * 10/2015 ..... A63B 24/0087
DE 102015117596 B3 * 8/2016 ..... A61B 5/4528
DE 102015117596 B3 8/2016
WO 9523574 A1 9/1995
WO 2012161443 A2 11/2012
WO 2015158664 A1 10/2015

* cited by examiner

DEVICE FOR CONVERTING A BED, IN PARTICULAR A CARE BED, SICK BED, HOSPITAL BED, OR INTENSIVE-CARE BED, FROM A HORIZONTAL POSITION INTO AN INCLINED POSITION WITH RESPECT TO THE LOGITUDINAL SIDES OF THE BED

BACKGROUND OF THE INVENTION

Field of the Invention

The present invention relates to a device for converting a bed, in particular a treatment bed, patient bed, hospital bed or intensive-care bed, from a horizontal position into a tilted position with respect to the longitudinal sides of the bed.

In the case of bedridden patients who are confined to bed for a prolonged period, particularly in the case of seriously ill intensive-care patients, physiotherapy is often required to maintain muscles, to build up muscles and/or to improve mobility. Depending on the state of health in each case, many of the patients have to remain in bed during physiotherapy (also referred to as mobilization). In order to improve the effectiveness of movement therapy, however, the patient should be in the vertical position if at all possible, as this affects processes in the body which support the recovery process, such as a reduction in the loss of muscle mass, a reduction in bone loss or also a reduced deterioration in cardiovascular endurance, for example.

However, seriously ill patients, in particular also patients whose consciousness is partially or completely limited, are often unable to leave their beds or can only leave them at great risk to their health. Ideally, patients in such cases should be able to be treated in bed, the bed preferably being capable of being converted from a horizontal position into a tilted position with respect to its longitudinal sides, in particular verticalized. However, in-bed exercise machines known in the art do not allow exercises in the vertical position in particular. However, so that the feet are completely or partially loaded with the pressure of the body's own weight, which can accelerate the healing process, e.g. after a joint replacement or bone fracture, it is necessary for the bedridden patient to be able to be moved partially or completely into a vertical position.

The greater the tilting angle of the longitudinal sides of the bed, and therefore of the bed itself, to the horizontal, the greater the weight force acting on the patient, in particular on their support system made up of bones, joints, tendons, muscles, etc., while in bed. During movement therapy, the aim is therefore normally to change the angle of inclination, depending on the state of health of the patient concerned, to angles >45°, preferably >75°, and ideally up to angles close to 90° which corresponds to an upright gait.

Within the context of this invention, the terms "verticalization mechanism", "verticalization of a bed" or "conversion of a bed from a horizontal position into a tilted position with respect to the longitudinal sides of the bed" should therefore be understood to means devices or processes which allow the maximum tilting angle of a bed in relation to its longitudinal side with respect to the horizontal of $45° \leq \alpha \leq 90°$, preferably angles >75°.

In this context, DE 20 2012 002 908 U1, U.S. Pat. No. 2,821,722 A, DE 94 20 429 U1 and also U.S. Pat. No. 3,310,289 A are known from the prior art.

DE 20 2012 908 U1 and DE 94 20 429 U1 disclose devices for transporting beds, in particular hospital beds. The devices, which both have a roughly "cart-like" or "lifting truck-like" design, each lift one side of the bed slightly from the floor so that two of the usually four casters on the bed are freely suspended in the air while the other two running casters are still in contact with the floor. The bed can then be easily transported in the slightly tilted position with the help of the respective device. The attainment of greater tilting angles, in particular those >45°, cannot be achieved with a device of this kind and is also not necessary for transporting beds. In addition, due to their entirely different objectives, the devices disclosed in these two publications also offer no possibility of supporting a bed in a tilted position safely and securely, so that a patient could perform physiotherapy in the bed.

Publications U.S. Pat. Nos. 2,821,722 A and 3,310,289 A each describe devices for lifting one side of a bed, for example for elevating the legs or the upper body of a patient in a bed. Both devices raise a transverse side of a bed in each case, wherein the bedposts of the opposite transverse side in each case remain on the floor. The tilting angles thereby achieved are so small that no securing and/or stabilization devices are provided for the patient during the tilting action, in order to prevent them from slipping. Furthermore, the devices disclosed do not allow a sufficiently secure stand during the tilting of the bed so that a patient in the bed could perform physiotherapy.

In order to solve the problems described, reference is made to an earlier patent application WO 2015/158664 A1 and also to the applicant's earlier patent DE 10 2015 117 596 B3, to which full reference is made in the context of the present invention and which already discloses a rehabilitation mechanism for bedridden patients and methods for the activation thereof and also a bed comprising the rehabilitation mechanism, in particular a treatment bed, patient bed, hospital bed or intensive-care bed which takes account of the above requirements.

However, the bed or standing frame known from these publications must comprise a verticalization mechanism, so that rehabilitation can be effectively carried out using the rehabilitation mechanism. Consequently, depending on the number of bedridden patients in a care home and/or hospital, additional, in some cases huge, investment is required, as beds with their own verticalization mechanism, in particular a treatment bed, patient bed, hospital bed or intensive-care bed, are substantially more expensive to purchase than comparable standard beds without their own verticalization mechanism.

SUMMARY OF THE INVENTION

Based on this, the problem addressed by the present invention is that of supplying a device for converting a bed, in particular a treatment bed, patient bed, hospital bed or intensive-care bed, from a horizontal position into a tilted, preferably verticalized, position with respect to its longitudinal side, which is improved, in particular more reasonably priced, compared with the prior art and to support the bed in a tilted position in such a manner that a patient can perform physiotherapy exercises, in particular movement therapy including own weight components.

This problem is solved by a device having the features as claimed.

The device according to the invention for converting a bed from a horizontal position into a tilted position with respect to its longitudinal sides is based on generic devices in that, the device has a receiving device for receiving the bed, and also a stand device for guaranteeing a stable stand of the device, and the receiving device and stand device are operatively connected to one another via at last one adjustment mechanism which tilts the receiving device with respect to the stand device.

The device according to the invention advantageously allows the conversion of standard beds without their own verticalization mechanism, in particular a treatment bed, patient bed, hospital bed or intensive-care bed, from a horizontal position into a tilted, preferably verticalized position, in relation to its longitudinal sides. This advantageously saves on the procurement of a special bed with its own verticalization mechanism and the costs associated with this.

The device according to the invention also allows the tilting, preferably the verticalization, of a bedridden patient in their (own) bed, wherein tilting angles between the receiving and stand device of up to 90° can be achieved. In this case, the interaction of the receiving and stand device supports and/or stabilizes the tilted, in particular verticalized, bed position in such a manner that the patient in the bed can perform physiotherapy exercises involving own weight components. The transfer of the patient into a separate piece of equipment with its own verticalization mechanism or from their own bed to a special bed with its own verticalization mechanism, which transfer goes hand-in-hand with a high level of risk for the patient's health and a great deal of effort on the part of staff, is thereby advantageously avoided.

Advantageous embodiments and developments which can be used individually or in combination with one another are the subject matter of the dependent claims.

In a first embodiment of the invention, it is preferred in this case for the receiving device and/or the stand device to be configured at least sectionally along both longitudinal sides of the bed, preferably substantially in a U-shape. The embodiment of the receiving and/or stand device at last sectionally along both longitudinal sides of the bed may advantageously facilitate a receiving of the bed close to its focal point, even when space is tight, as has now become the case in hospitals and/or care homes. "Receiving" in this case should be understood to mean within the context of this invention an interaction between the receiving device and the bed which allows the bed to be lifted from the floor during conversion from a horizontal position into a tilted position with respect to its longitudinal sides. In a preferred embodiment, the bed can be completely raised from the floor in this case, so that all bedposts, casters and/or any other support devices of the bed are spaced apart from the floor, in particular from the floor of the patient's room. Particularly on intensive-care wards, intensive-care beds may be positioned in such a manner that the top part of the bed can only be reached with difficulty, as apparatus for monitoring the vital parameters and also for performing life-supporting measures are usually arranged there. A substantially U-shaped receiving and/or stand device may in this case advantageously facilitate the receiving of a treatment bed, patient bed, hospital bed or intensive-care bed by moving up to the bed via the bottom end thereof or by introducing the bed into the gap formed by the U-shape. Moreover, a cross strut such as that preferably realized by the U-shaped design helps to reinforce the receiving and/or stand device when gripping the longitudinal sides of the bed. In addition, the cross strut may advantageously produce an attachment point for a stabilization mechanism for holding and/or stabilizing a bedridden patient.

Consequently, in a preferred embodiment, a stabilizing mechanism of this kind is provided to hold—preferably receiving all or part of the weight of a bedridden patient—and/or stabilize a patient. This advantageously allows the use of therapy in which the patient trains in a controlled manner bearing their entire, or only partial, body weight. The stabilization mechanism in this case may advantageously prevent the patient from slipping in the bed, in particular at tilting angles >45°.

In a further embodiment of the device, it has proved successful for the adjustment mechanism to comprise at least one sensor for detecting the tilting angle and/or the tilting speed between the receiving device and the stand device. A sensor of this kind may advantageously supply actual values of a tilting angle between the receiving device and the stand device.

Moreover, an embodiment according to the invention is preferred in which at least one control device is provided for interaction with the adjustment mechanism, in particular for setting control parameters such as a tilting angle, in particular, between the receiving device and the stand device and/or a tilting speed. This has the advantage that the operation of the adjustment mechanism can take place in a controlled manner via a control loop for comparing actual values of the tilting angle with the desired target values of the tilting angle that can be defined via the control device, wherein all intermediate stages can preferably be started at $0° \leq \alpha \leq 90°$. Moreover, different tilting speeds can advantageously be selected via the control device, e.g. a rapid movement during no-load operation for maintenance or cleaning and also for rapid horizontalization in case of an emergency involving resuscitation and a slow movement for the safe and comfortable movement of the bedridden patient.

For this purpose, it is also preferable for the adjustment mechanism to have at least one drive, in particular a pneumatic, hydraulic and/or preferably electromechanical drive for moving the receiving device with respect to the stand device. In particular, an electromechanical drive guarantees an easily controllable movement in this case for converting the bed from a horizontal position into a tilted position with respect to its longitudinal sides which can advantageously be adapted to the respective needs of the bedridden patient.

In a further preferred embodiment according to the invention, load rollers and/or casters for moving the device in any directions parallel to the floor and support elements for the stable support of the device on the floor are provided on the stand device. Alternatively to this, the stand device according to the invention preferably has fastening means which allow the device to be fastened to a floor and/or wall section. Load rollers and/or casters on the stand device advantageously allow a mobile embodiment of the device which flexibly replace multiple beds with their own verticalization mechanism and are therefore able to improve the utilization of resources. For safety reasons, support elements are then provided in the mobile embodiment of the invention which advantageously fix the device to the floor during operation and enable the patient to perform physiotherapy exercises in the bed in a tilted, particularly verticalized, position when the device has a stable standing. In the variant comprising a permanently installed unit, the stand device preferably has fastening means which in turn advantageously allow fixing of the device to a floor and/or wall section (substantially permanently this time). The permanently installed variant of the invention is particularly suitable for medium- and long-term treatment of a bedridden patient. This means that any treatment bed, patient bed, hospital bed or intensive-care bed can be equipped for the treatment duration with one or more permanently installed variants of the invention and optimized to suit for the special needs of the patient concerned.

Moreover, it has proved successful for the device to have a rehabilitation mechanism for interaction with a bedridden patient, at least comprising a support plate, a foot module and/or a knee module. It is known in the art for bedridden patients, in particular intensive-care patients, to benefit greatly from physiotherapy measures which, however, are time-consuming and staff-intensive. If the device in a preferred embodiment has a rehabilitation mechanism of this kind, early mobilization of intensive-care patients in bed with a simultaneous lessening of the burden on care staff can advantageously be made possible.

Physiotherapy involving at least part of the patient's own body weight can advantageously prevent muscle wastage in bedridden patients and/or promote muscle-building. Moreover, it is known in the art for physical stimuli also to have an advantageous effect on the cognitive skills of coma patients, in particular. The actual physical load placed on a patient should, however, be well adapted or measured on a patient-specific basis, so that it can have a positive effect on the recovery process.

For this purpose, it has proved successful in one embodiment of the invention for the supporting plate and/or a foot module arranged on said supporting plate to be arranged on the bed in a manner capable of being brought into operative connection with the feet and/or the soles of the feet of a bedridden patient, wherein the support plate can preferably be configured in an insertable or movable manner in relation to the longitudinal sides of the bed. Moreover, it has proved successful in one embodiment for the rehabilitation mechanism to have at least one horizontal displacement means, in particular at least one rail or a spindle drive, for moving the support plate. In addition, it is preferable for the rehabilitation mechanism to comprise at least one weight sensor and/or one motor to guarantee a controlled displacement movement of the support plate. When converting a bed from a horizontal position in relation to its longitudinal side into a tilted position, the downwardly acting force on a bedridden patient in the bed increases with the tilting angle. When the foot is in contact with a rehabilitation mechanism, in particular with a support plate, the loading of the patient's musculoskeletal system therefore also increases with the tilting angle due to gravity. A movement performed manually or by means of a motor, for example, of the support plate controlled by a weight sensor and, for example, guided by at least one, preferably two, horizontal bars arranged on the longitudinal side of the bed, may in this case control the displacement movement of the support plate in relation to the patient on the one hand and, on the other hand, advantageously facilitate at least partially a metering of the weight actually acting on the patient's musculoskeletal system.

An embodiment is preferred in this case in which the device has at least one interface for connection of the rehabilitation mechanism to the control device and/or in which the control device is preferably operatively connected to the weight sensor and/or to the motor, preferably to both, to control the interaction of the rehabilitation mechanism and adjustment mechanism. This has the advantage that by means of the control device, both the rehabilitation mechanism and also the adjustment mechanism can be actuated via the control device and all control parameters (target values) compared with current actual values of the sensor to detect the tilting angle and/or the weight sensor.

Finally, an embodiment of the invention has proved successful in which the device comprises a transport means, in particular a trolley, for the transport and/or operative connection of the rehabilitation mechanism to the bed. In particular, in the variant as a permanently installed device, the rehabilitation mechanism can be conveniently transported to the bed and/or away from the bed with the help of a transport means, in particular a trolley, which advantageously makes it easier for the care staff both to introduce the bed into the device and also to attach the rehabilitation mechanism to the bed.

The present invention provides both a mobile and also a stationary device for converting a bed, in particular a treatment bed, patient bed, hospital bed or intensive-care bed from a horizontal position into a tilted, preferably verticalized, position with respect to its longitudinal side. This advantageously involves uncoupling the verticalization process from the bed concerned in each case and in this way allows great flexibility for the care staff in their daily treatment routine in a care home and/or hospital, particularly due to its multi-functionality, and therefore safe and comfortable treatment for a bedridden patient. The device according to the invention is suitable both for new installation and also for retrofitting to the hardware in hospitals and/or care homes and advantageously saves the investment otherwise necessary in beds with their own verticalization mechanism. In particular, due to the flexibility of the invention, irrespective of whether it is designed as a mobile or stationary device, a smaller number of devices according to the invention is required compared with the number of beds with their own verticalization mechanism that would otherwise have to be purchased, which results in additional cost savings.

Further advantages and embodiments are described below with the help of preferred exemplary embodiments and also in connection with the drawing.

DESCRIPTION OF THE INVENTION

In the following description of preferred embodiments of the present invention, the same reference numbers are used to denote identical or comparable components.

Figure 1:
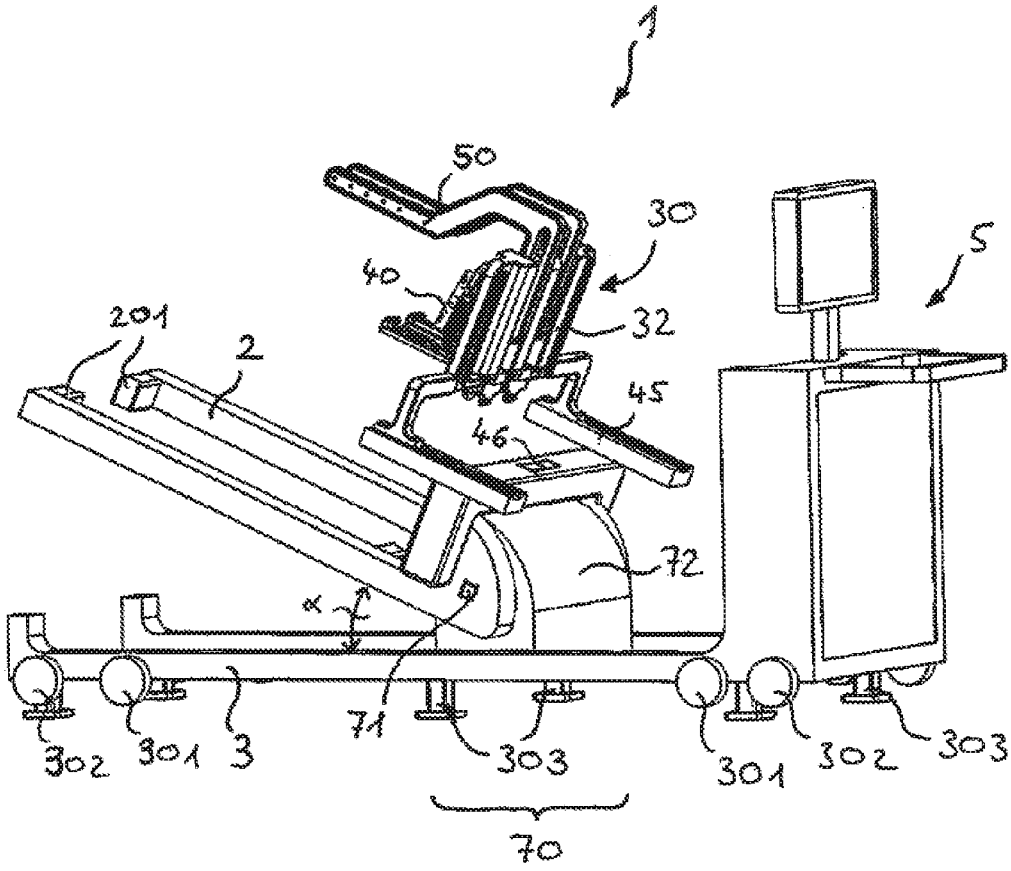
FIG. 1 a mobile embodiment of a device for converting a bed, in particular a treatment bed, patient bed, hospital bed or intensive-care bed, from a horizontal position into a tilted position with respect to its longitudinal sides, having a rehabilitation mechanism with a foot and knee module with a tilting angle between a receiving mechanism and a standing mechanism of $0° < \alpha < 90°$ as a perspective side view.

FIG. 1 shows a mobile embodiment of a device 1 for converting a bed 10 (not shown here), in particular a treatment bed, patient bed, hospital bed or intensive-care bed, from a horizontal position into a tilted position relative to its longitudinal sides 12, comprising a rehabilitation mechanism 30 with a foot module 40 and a knee module 50 with a tilting angle $\alpha$ between a receiving device 2 and a stand device 3 of $0°<\alpha<90°$ as a perspective side view. The device 1 depicted according to the invention has a receiving device 2 for receiving the bed 10 and a stand device 3 for guaranteeing a stable stand of the device 1, wherein according to the invention load rollers 301 and/or casters 302 are preferably provided on the stand device 3 for moving the device 1 in any directions parallel to the floor and support elements 303 for the stable supporting of the device 1 on the floor, in particular during the administering of movement therapy or physiotherapy. The receiving device 2 and the stand device 3 are, moreover, operatively connected to one another according to the invention via at least one adjustment mechanism 70, wherein the adjustment mechanism 70 can tilt the receiving device 2 in respect of the stand device 3. According to the invention, the adjustment mechanism 70 preferably also comprises at least one sensor 71 for detecting the tilting angle $\alpha$ and/or the tilting speed between the receiving device 2 and the stand device 3. Moreover, the adjustment mechanism 70 preferably has at least one drive 72, in particular a pneumatic, hydraulic and/or preferably electromechanical drive 72, for moving the receiving device 2 in relation to the stand device 3. It has proved successful in this case for at least one control device 5 to be provided for interaction with the adjustment mechanism 70, in particular for setting control parameters, such as, in particular, the tilting angle $\alpha$ between the receiving device 2 and the stand device 3 and/or the tilting speed.

Figure 2:
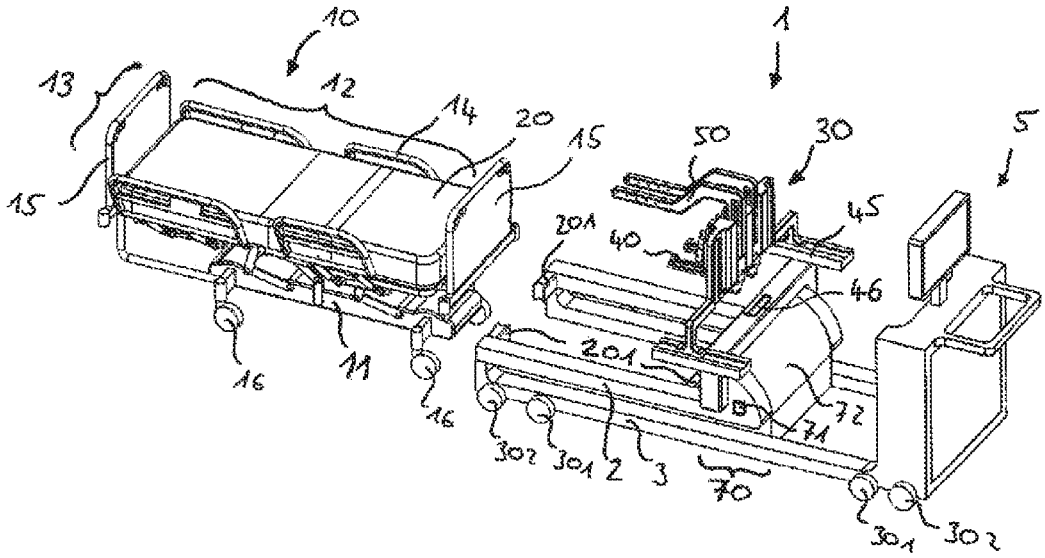
FIG. 2 the device from FIG. 1 at a tilting angle of $\alpha = 0°$ and also a bed, in this case a standard hospital bed, during movement of the device up to the bed.

FIG. 2 shows the device 1 from FIG. 1 at a tilting angle $\alpha$ of $\alpha=0°$, and also a bed 10, in this case a standard hospital bed by way of example, when moving the device 1 up to the bed 10. It is possible to see that the receiving device 2 and/or the stand device 3, preferably both as depicted here, can be configured at least sectionally along both longitudinal sides 12 of the bed 10, preferably in a substantially U-shaped manner, which advantageously allows the bed 10 to be moved up and received via the bottom end of the bed. In particular, the transverse side limit 15 of the bed 10 at the bottom end shown in FIG. 2 may be removed before the device 1 is moved up, so that the rehabilitation mechanism 30 of the device 1 is not obstructed. Movement up to the bed 10 may advantageously be facilitated by the load rollers 301 and casters 302 provided on the stand device 3, wherein during this any support elements 303 (see FIG. 3) are arranged for the stable supporting of the device 1 on the floor in a position without contact with the floor on the stand device 3.

Figure 3:
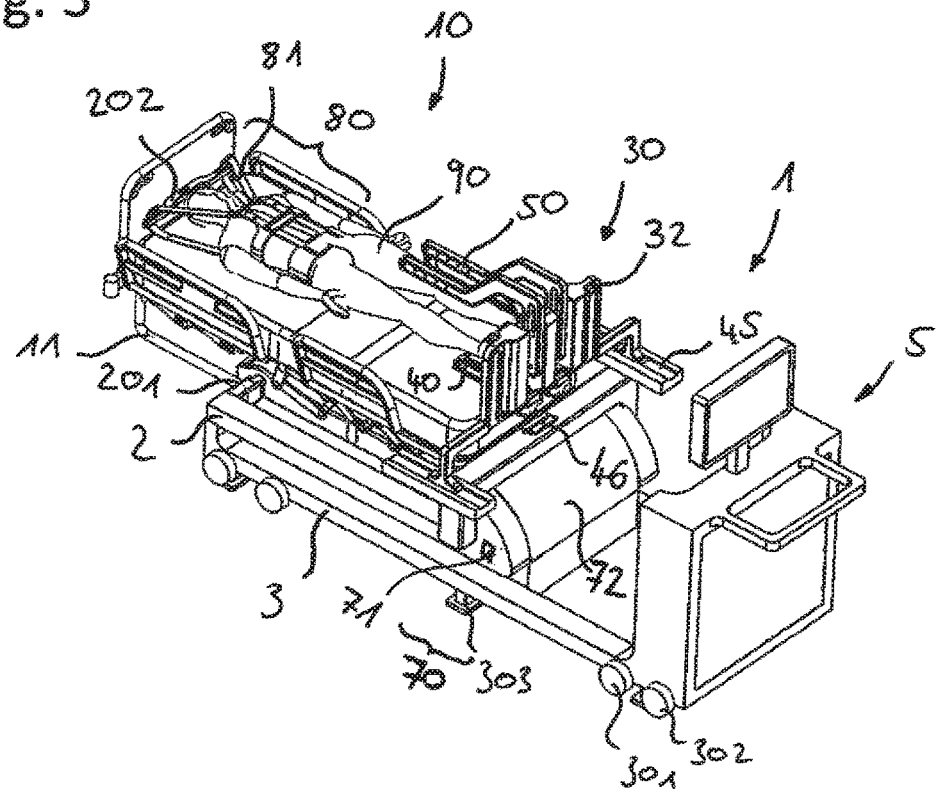
FIG. 3 a bedridden patient stabilized in the bed by means of a stabilizing mechanism with the device moved up to it at a tilting angle of $\alpha = 0°$.

FIG. 3 then shows a bedridden patient 90 stabilized by means of a stabilizing mechanism 80 on a mattress 20 in the bed 10 with the device 1 moved up at a tilting angle $\alpha$ of $\alpha=0°$. The situation depicted is immediately before treatment begins, so before the bed 10 is converted from a horizontal position into a tilted position in relation to its longitudinal sides 12. As can be seen, the supporting elements 303 are extended and can make contact with the floor, in order to support the device 1 in a stable manner on the floor. The bed 10 may preferably be received by means of fixing blocks 201 which particularly interact with the bed frame 11 through the receiving device 2, preferably completely. The bedridden patient 90 is held by means of a stabilization mechanism 80, in this case for example by means of a weight-relieving means 81 fastened via a support 202 to the transverse side limit 15 of the bed 10 at the head end, and is operatively connected to a foot module 40 of a rehabilitation mechanism 30 via the soles 95 of their feet 94. As an alternative to this, the stabilization mechanism 80 may also be created by at least one, preferably by multiple holding straps running crosswise (not shown here) for holding and/or stabilizing the patient 90. It can be seen in addition from FIG. 3 that the operative connection between the feet 94 and/or the soles 95 of the bedridden patent 90 and the support plate 32 and/or a foot module 40 arranged thereon, can preferably be produced by the displacement of the support plate 32 with respect to the longitudinal sides 12 of the bed 10. For this purpose, the rehabilitation mechanism 30 preferably has at least one horizontal displacement means, in particular at least one or preferably, as depicted, two guide rails 45 for moving the support plate 32. Alternatively, the support plate 32 can also be moved with respect to the longitudinal sides 12 of the bed 10, in particular via a spindle drive arranged on the support plate 32. The displacement movement of the support plate 32 may, on the one hand, be realized manually and/or by a motor 46 preferably arranged on the rehabilitation mechanism 30, wherein it has proved successful for the rehabilitation mechanism 30 to comprise a weight sensor 44 in order to guarantee a controlled displacement movement of the support plate 32. In the mobile embodiment shown in FIG. 3, the device 1 according to the invention preferably has, in addition, at least one interface 203 (cannot be seen here) for connecting the rehabilitation mechanism 30 to the control device 5, which can provide a permanent connection, particularly in the mobile embodiment. Consequently, the control device 5 is operatively connected in order to control the interaction of the rehabilitation mechanism 30 and the adjustment mechanism 70 in a preferred embodiment to the weight sensor 44 and/or to the motor 46, preferably to both.

Figure 4:
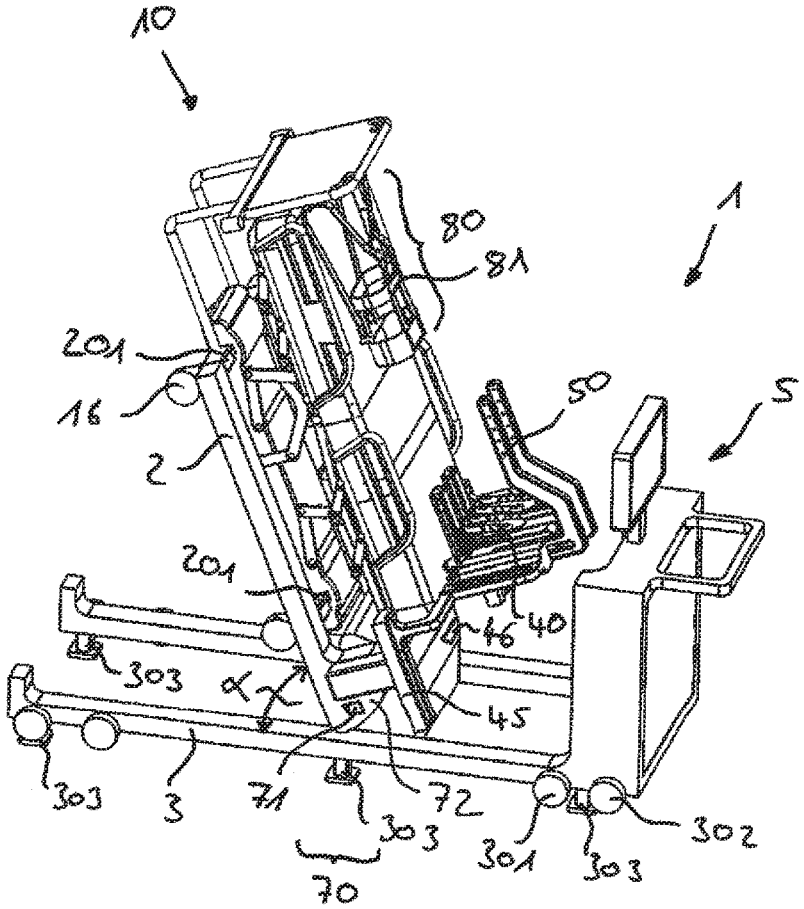
FIG. 4 the device from FIG. 1 with the bed at a tilting angle of $0° < \alpha < 90°$ as a perspective side view.

FIG. 4 shows the device 1 from FIG. 1 with the bed 10 at a tilting angle $\alpha$ of $0°<\alpha<90°$ as a perspective side view. Unlike in FIG. 3, the support plate 32 in this case along with the rehabilitation mechanism 30 is arranged in the closest position in respect of the patient 90 (no longer shown here). The displacement of the support plate 32 takes place in particular by means of two guide rails 45 and can, in the case depicted here, facilitate the treatment of patients 90 with a comparatively short height. In addition, the rehabilitation mechanism 30 can in this way be advantageously moved up to the patient 90, which prevents the patient 90 from slipping towards the bottom of the bed when a bed 10 is being converted from a horizontal position into a tilted position ($0°<\alpha<90°$) with respect to its longitudinal sides 12. In this position with a tilting angle $\alpha$ of $0°<\alpha<90°$ between the receiving device 2 and the stand device 3 in which the bed 10 is completely received and is not in contact with the floor with any of its casters 16, at least part of the weight force of the patient's own body weight acts on the bedridden patient 90. A tilted position of this kind may advantageously improve the effectiveness of a bout of physiotherapy, in particular by means of the rehabilitation mechanism with a foot module 40 and/or a knee module 50, as already disclosed in the applicant's earlier patent DE 10 2015 117 596 B3. In relation to the method of operation of a rehabilitation mechanism 30, in particular with a carrier plate 32, a foot module 40 and/or a knee module 50, reference is made in full to the cited patent DE 10 2015 117 596 B3.

Figure 5:
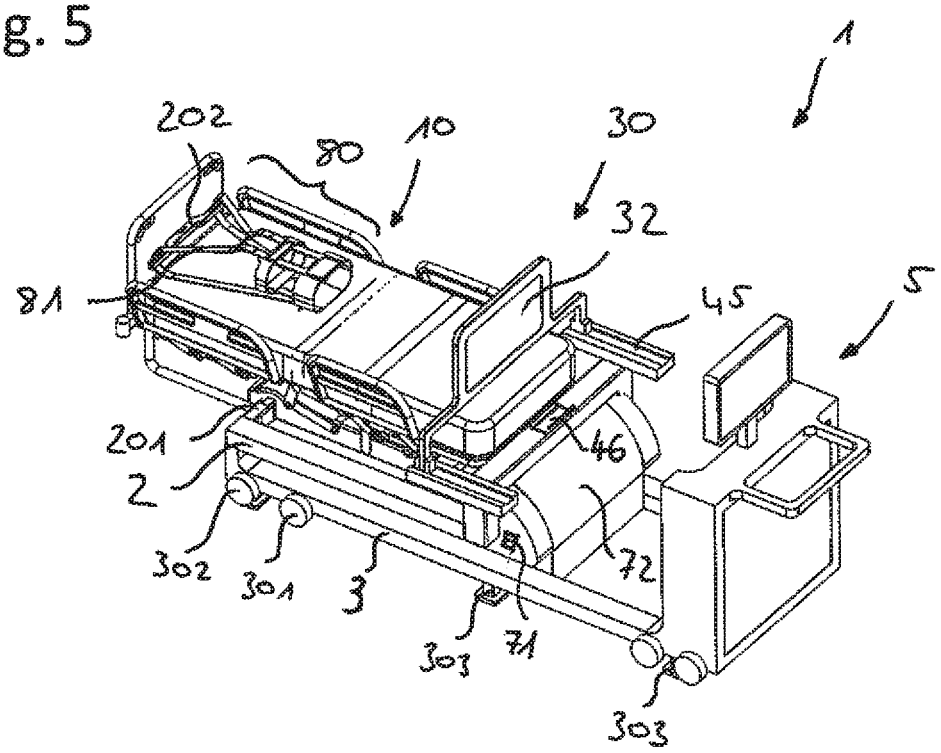
FIG. 5 an embodiment of the device in which the rehabilitation mechanism is configured as a support plate without a foot and knee module with the bed held as in FIG. 3.
Figure 6:
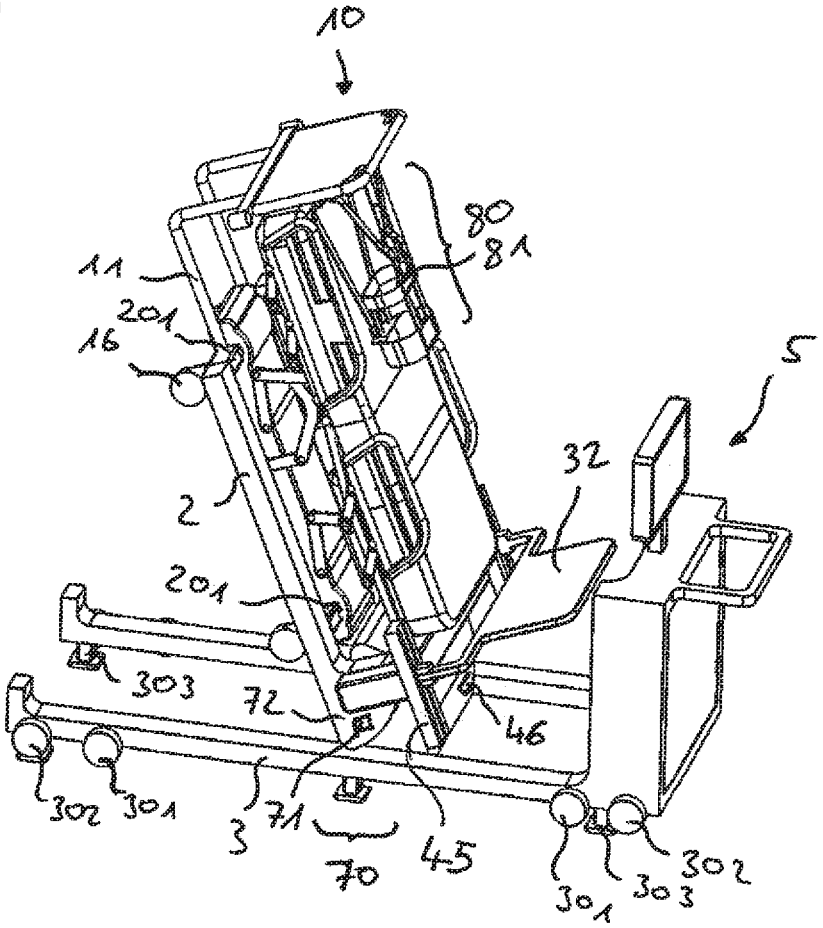
FIG. 6 the embodiment of the device from FIG. 5 at a tilting angle of $0° < \alpha < 90°$.

FIG. 5 and FIG. 6 show a further embodiment of the device 1 in which the rehabilitation mechanism 30 is designed as a support plate 32 without a foot module 40 and a knee module 50, with the bed 10 held as in FIG. 3 at a tilting angle $\alpha$ of $\alpha=0°$ (FIG. 5), and also at a tilting angle $\alpha$ of $0°<\alpha<90°$, in particular, as can be seen here, at a tilting angle $45°<\alpha<90°$ (FIG. 6). In this embodiment, the bedridden patient 90 can stand on the support plate 32, held and/or stabilized by the stabilization mechanism 80 configured here as a weight-relieving means 81 and exposed to at least part of the weight force of their own body weight and, in particular, do exercises independently or supported by care staff.

Figure 7:
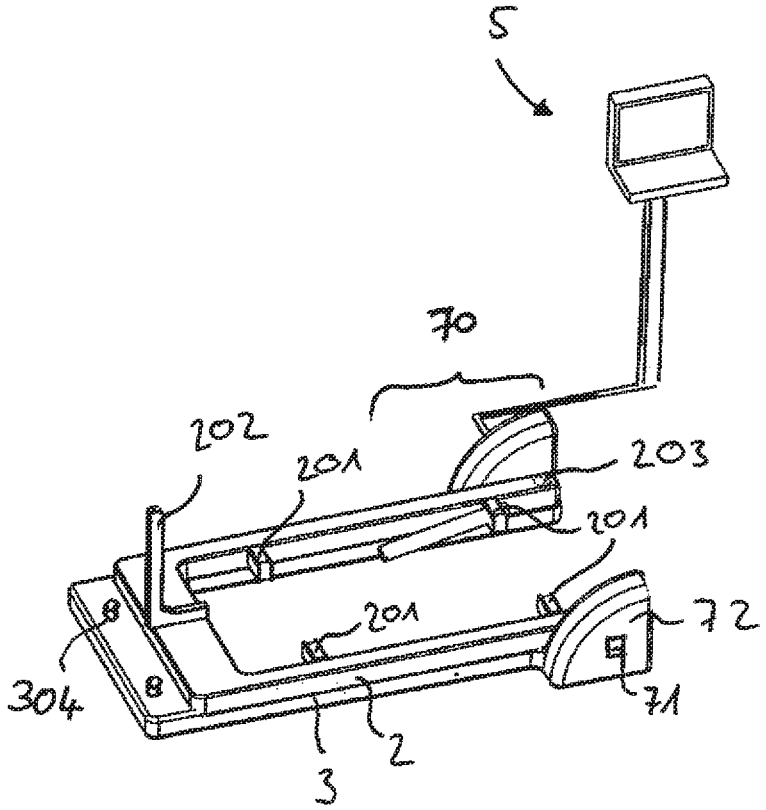
FIG. 7 the permanently installed part of a stationary embodiment of the device for converting a bed, in particular a treatment bed, patient bed, hospital bed or intensive-care bed, from a horizontal position into a tilted position with respect to its longitudinal sides at a tilting angle of $\alpha = 0°$ as a perspective side view.

FIG. 7 shows by way of example the permanently installed part of a stationary embodiment of the device 1 for converting a bed 10, in particular a treatment bed, patient bed, hospital bed or intensive-care bed, from a horizontal position into a tilted positon in relation to its longitudinal sides 12 at a tilting angle $\alpha$ of $\alpha=0°$ as a perspective side view. As opposed to the mobile embodiment, depicted by way of example in FIG. 1 to FIG. 6, the stand device 3 in the stationary variant of the invention has fastening means 304 which allow the device 1 to be fastened to a floor and/or wall section. As fastening means 304, screws in particular can be used for mechanical fastening and/or a counterweight arranged on the stand device 3 for lowering the focal point and increasing the dead weight of the device 1. In the embodiment shown in FIG. 7, the support 202 for the weight-relieving means 81 is arranged on the receiving device 2, for example. Moreover, the interface 203 for connecting the rehabilitation mechanism 30 to the control device 5 can be seen in FIG. 7, which interface can preferably be of detachable design in the stationary embodiment of the invention. Unlike in the mobile embodiment of the device 1, the rehabilitation mechanism 30 is, moreover, preferably separately configured according to the invention and is preferably transported to the bed 10 following the introduction of the bed 10 into the fixed part of the device 1 by way of a transport means 4 and then coupled to said bed.

Figure 8:
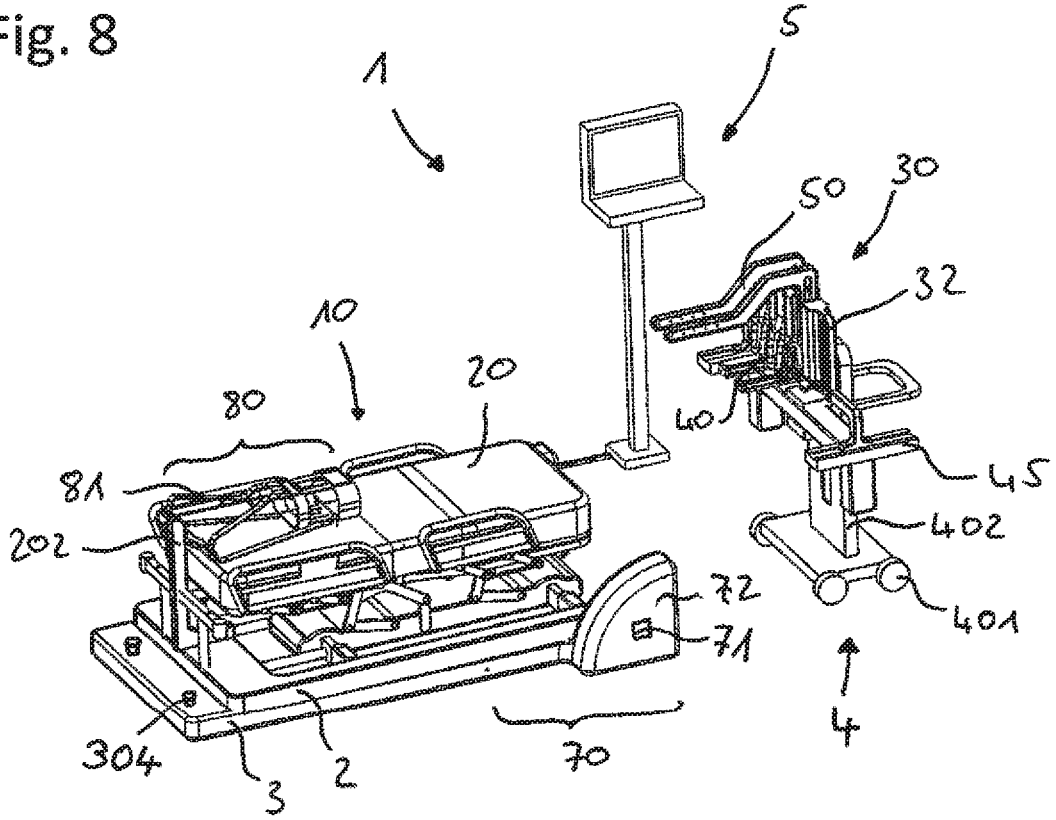
FIG. 8 the permanently installed part of a stationary embodiment of the device from FIG. 7 with the bed held, and also a transport means, in this case a trolley, along with the transported rehabilitation mechanism with the support plate, foot and knee module prior to attachment to the bed.

FIG. 8 shows a preferred embodiment of the invention according to the invention with the fixed part of a stationary embodiment of the device 1 from FIG. 7 with the bed 10 held, and also a transport means 4, in this case a trolley, together with the transported rehabilitation mechanism 30 with support plate 32, foot module 40 and knee module 50 prior to attachment to the bed 10.

Figure 9:
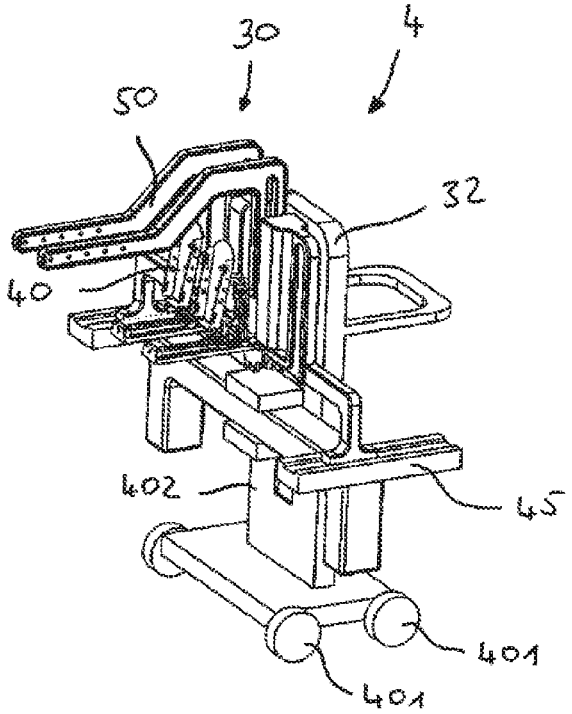
FIG. 9 an enlarged view of the transport means in the form of a trolley from FIG. 8 along with the rehabilitation mechanism transported therewith with the support plate, foot and knee module.

FIG. 9 shows an enlarged view of the transport means 4 from FIG. 8 configured as a trolley, along with the rehabilitation mechanism 30 transported therewith with the support plate 32, foot module 40 and knee module 50. As shown, the trolley has rollers 401 for locomotion and also at least one vertical rail 402 for achieving vertical movement of the rehabilitation mechanism 30.

Figure 10:
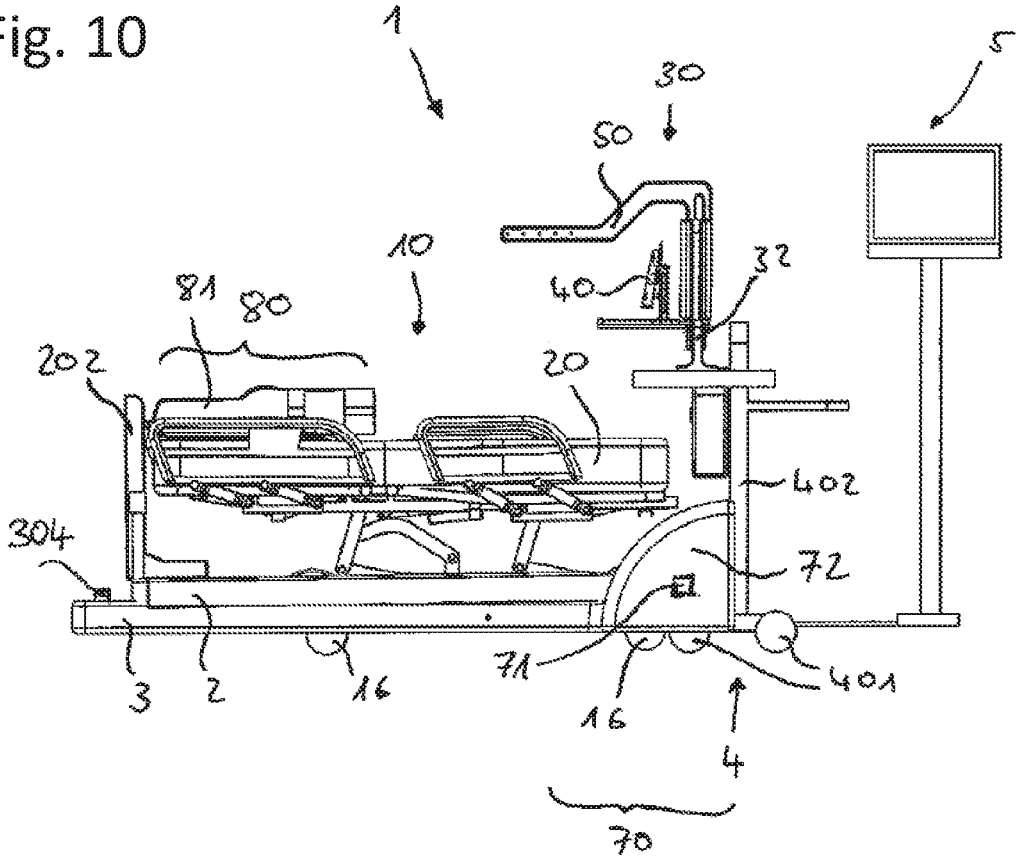
FIG. 10 a side view of a stationary embodiment of the device with the bed held and the rehabilitation mechanism moved up to it before the rehabilitation mechanism is connected to a control device via at least one interface.

FIG. 10 shows a side view of a stationary embodiment of the device 1 with the bed 10 held and the rehabilitation mechanism 30 moved up to it before the connection of the rehabilitation mechanism 30 to the control device 5 via at least one interface 203. It can be seen that the rehabilitation mechanism 30 is still attached to the transport means 4 and is located in a higher vertical position on the vertical rail 402 of the transport means 4.

Figure 11:
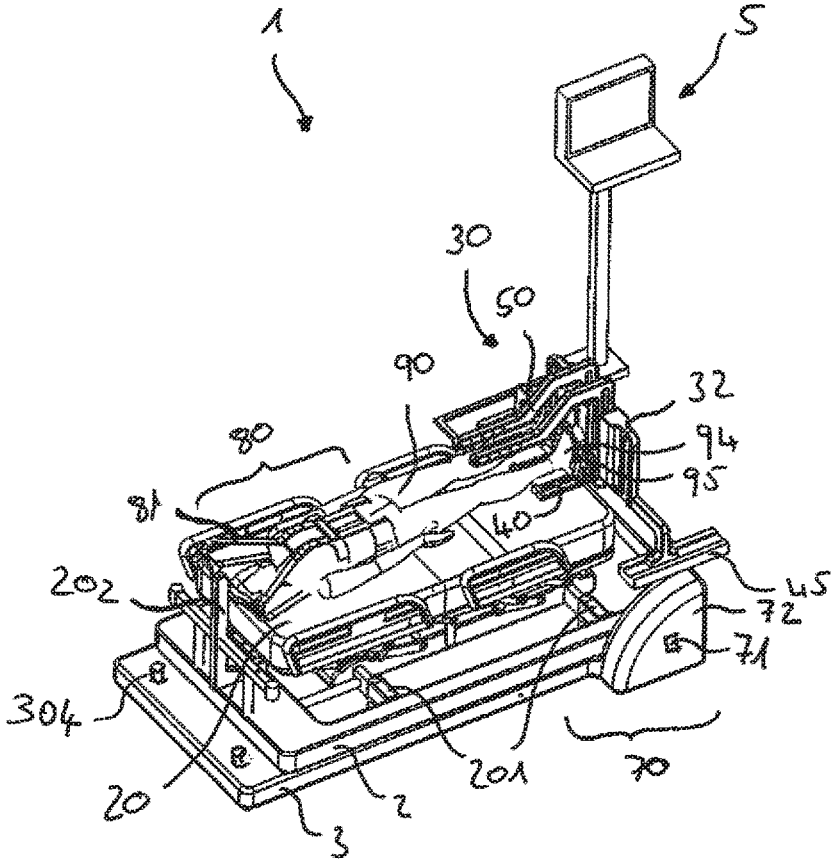
FIG. 11 a bedridden patient stabilized by means of a stabilization mechanism in the bed from FIG. 10, held by a stationary embodiment of the device following connection of the rehabilitation mechanism to the device and removal of the transport means at a tilting angle of $\alpha=0°$.
Figure 12:
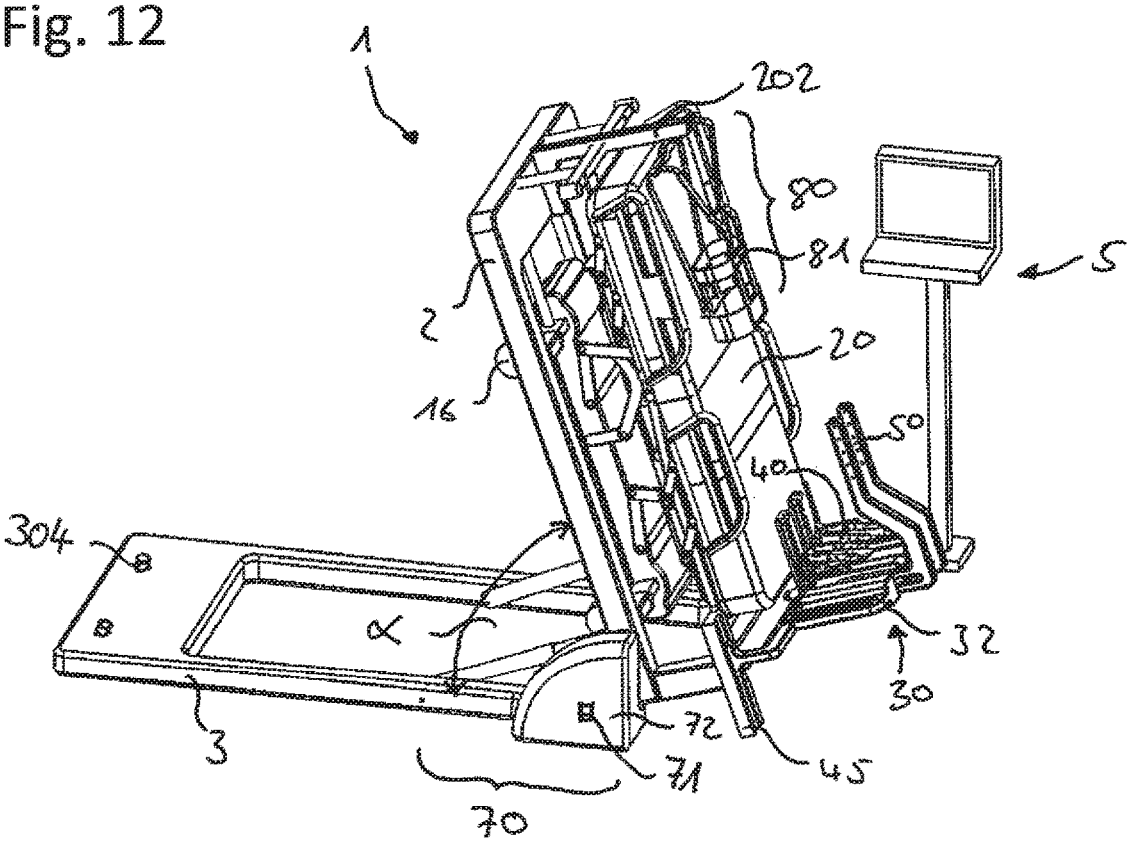
FIG. 12 the device from FIG. 11 with the bed at a tilting angle of $0°<\alpha<90°$ as a perspective side view.

FIG. 11 then shows a bedridden patient 90 stabilized by means of a stabilization mechanism 80 on a mattress 20 in the bed 10 from FIG. 10, held by a stationary embodiment of the device 1 following connection of the rehabilitation mechanism 30 to the device 1 and removal of the transport means 4 at a tilting angle $\alpha$ of $\alpha=0°$. The rehabilitation mechanism 30 is lowered and connected via the interface 203 to the control device 5. As in FIG. 3, the patient 90 is already operatively connected to a foot module 40 of a rehabilitation mechanism 30 via the soles 95 of their feet 94 and can be treated following the setting of a tilting angle $\alpha$ of $0°<\alpha<90°$, as shown in FIG. 12, in a similar manner to FIG. 4.

Figure 13:
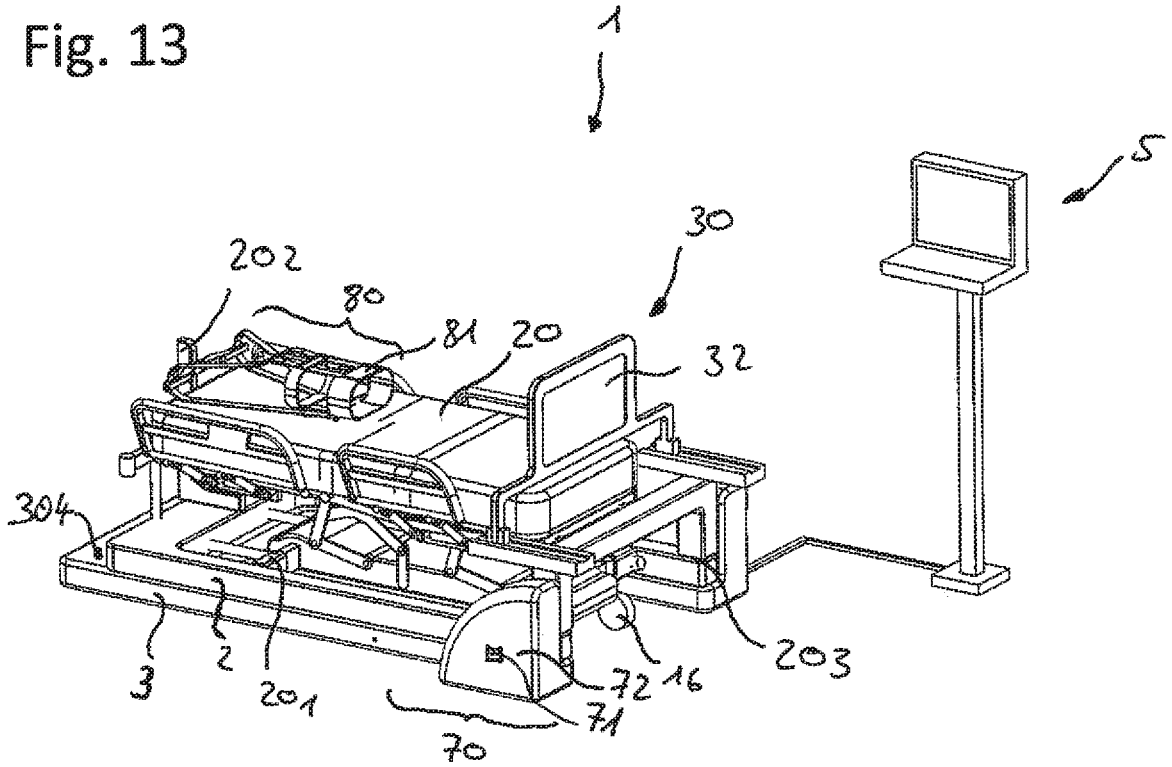
FIG. 13 an embodiment of the device from FIG. 11, in which the rehabilitation mechanism is designed as a support plate without a foot and knee module, with the bed held.
Figure 14:
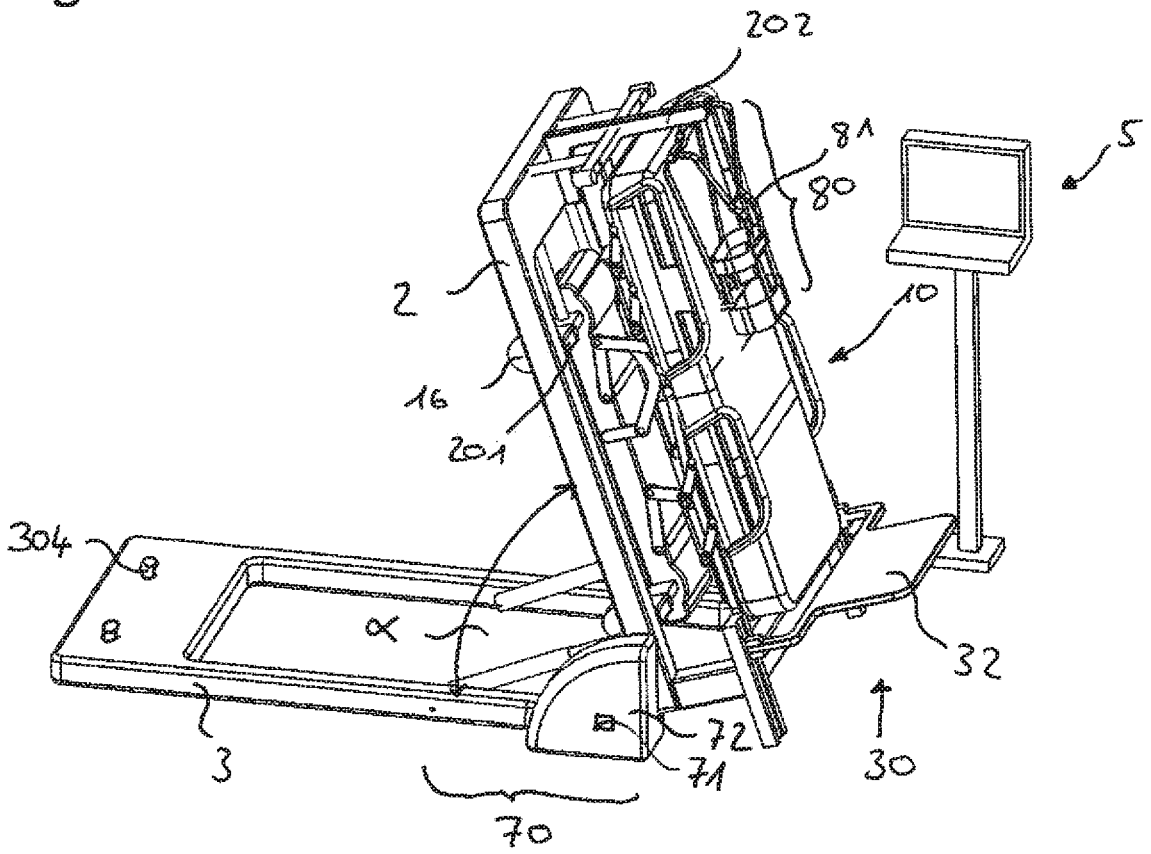
FIG. 14 the embodiment of the device from FIG. 13 at a tilting angle of $0°<\alpha<90°$.

FIGS. 13 and 14 finally show an embodiment of the device 1 from FIG. 11, in which the rehabilitation mechanism 30 is configured as a support plate 32 without a foot module 40 or a knee module 50 with the bed 10 held at a tilting angle $\alpha$ of $\alpha=0°$ (FIG. 13), and also at a tilting angle $\alpha$ of $0°<\alpha<90°$, in particular, as can be seen here, at a tilting angle $45°<\alpha<90°$ (FIG. 14).

The present invention provides both a mobile and a stationary device 1 for converting a bed 10, in particular a treatment bed, patient bed, hospital bed or intensive-care bed, from a horizontal position into a tilted, preferably verticalized, position in relation to its longitudinal side 12. During this, it advantageously uncouples the verticalization process from the bed 10 concerned in each case and in this way allows great flexibility for the care staff in their daily treatment routine in a care home and/or hospital, particularly due to its multi-functionality, and therefore safe and comfortable treatment for a bedridden patient 90.

The device 1 according to the invention is suitable both for new installation and also for retrofitting to the hardware in hospitals and/or care homes and advantageously saves the investment otherwise necessary in beds with their own verticalization mechanism 70. In particular, due to the flexibility of the invention, irrespective of whether it is designed as a mobile or as a stationary device 1, a smaller number of devices 1 according to the invention is required compared with the number of beds 10 with their own verticalization mechanism 70 which would otherwise have to be purchased, which results in additional cost savings.

LIST OF REFERENCE NUMBERS

1 Device
2 Receiving device

201 Fixing block
202 Support for weight-bearing means
203 Interface
3 Stand device
301 Load rollers
302 Casters
303 Support element
304 Fastening means
4 Transport means (in particular a trolley)
401 Running rollers
402 Vertical rail
5 Control device
10 Bed, in particular: treatment bed, patient bed, hospital bed or intensive-care bed
11 Bed frame
12 Longitudinal side
13 Transverse side
14 Longitudinal side limit
15 Transverse side limit
16 Casters
20 Mattress
30 Rehabilitation mechanism
32 Carrier plate for rehabilitation mechanism 30 that can be fixed to the bed 11
40 Foot module
44 Weight sensor
45 Horizontal rail
46 Motor
50 Knee module
70 Adjustment mechanism
71 Sensor for detecting the tilting angle α
72 Drive
80 Stabilization mechanism
81 Weight-relieving means
82 Holding strip
90 Patient
94 Foot
95 Sole
α Tilting angle

The invention claimed is:

1. A configuration for moving a bed from a horizontal position into a tilted position with respect to longitudinal sides of the bed, the configuration comprising:

a receiving device for receiving the bed by engaging the bed, said receiving device configured for lifting the bed from the floor during conversion of the bed from the horizontal position into the titled position with respect to the longitudinal sides;

a stand device configured to provide for a stable stand of the configuration, at last one adjustment mechanism operatively connecting said receiving device with said stand device and configured to tilt said receiving device with respect to said stand device.

2. The configuration according to claim 1, wherein at least one of said receiving device or said stand device is formed, at least in sections, along both longitudinal sides of the bed.

3. The configuration according to claim 2, wherein said at least one of said receiving device or said stand device is formed to straddle the bed in a U-shape.

4. The configuration according to claim 1, further comprising a stabilizing mechanism to hold and/or stabilize the patient.

5. The configuration according to claim 1, wherein said adjustment mechanism comprises at least one sensor for detecting a tilting angle (α) and/or a tilting speed between said receiving device and said stand device.

6. The configuration according to claim 1, further comprising at least one control device for interaction with said adjustment mechanism for setting control parameters of said adjustment mechanism.

7. The configuration according to claim 6, wherein said at least one control device is configured to setting a tilting angle (α) between said receiving device and said stand device and/or a tilting speed.

8. The configuration according to claim 1, wherein said adjustment mechanism comprises at least one drive for moving said receiving device with respect to said stand device.

9. The configuration according to claim 8, wherein said at least one drive for moving said receiving device with respect to said stand device is a drive selected from the group consisting of a pneumatic drive, a hydraulic drive, and an electromechanical drive.

10. The configuration according to claim 1, wherein:

said stand device includes:

load rollers and/or castors for moving the configuration in any direction parallel to a floor; and support elements for the stable support of the configuration on the floor;

or fastening means for fastening the configuration to the floor and/or to a wall.

11. The configuration according to claim 1, further comprising a rehabilitation mechanism for interaction with a bedridden patient, said rehabilitation mechanism including at least one of a support plate, a foot module, or a knee module.

12. The configuration according to claim 11, wherein said support plate and/or a foot module arranged thereon are mounted to the bed for movement into an operative connection with the feet and/or the soles of a bedridden patient.

13. The configuration according to claim 11, wherein said support plate is mounted for insertion or for movement relative to the longitudinal sides of the bed.

14. The configuration according to claim 13, wherein said rehabilitation mechanism further comprises at least one horizontal displacement device for moving the support plate.

15. The configuration according to claim 14, wherein said at least one horizontal displacement device is at least one guide rail or a spindle drive.

16. The configuration according to claim 14, wherein said rehabilitation mechanism comprises at least one weight sensor and/or one motor to ensure a controlled displacement movement of said support plate.

17. The configuration according to claim 14, further comprising at least one interface for connection of said rehabilitation mechanism to a control device.

18. The configuration according to claim 16, wherein a control device for controlling an interaction of said rehabilitation mechanism and said adjustment mechanism is operatively connected to said weight sensor and/or to said motor.

19. The configuration according to claim 11, further comprising a transport means for transporting and for attaching and/or operatively connecting said rehabilitation mechanism to the bed.

20. The configuration according to claim 1, wherein said receiving device is configured to support a bed selected from the group consisting of a treatment bed, a patient bed, a hospital bed, and an intensive-care bed.

* * * * *